US005471022A

United States Patent [19]

Kiss et al.

[11] Patent Number: 5,471,022

[45] Date of Patent: Nov. 28, 1995

[54] PNEUMATIC ACUTATED SWITCH

[75] Inventors: Vince Kiss, Concord Township; Matthew A. Davis, Mentor, both of Ohio

[73] Assignee: Tridelta Industries, Inc., Mentor, Ohio

[21] Appl. No.: 300,410

[22] Filed: Sep. 2, 1994

[51] Int. Cl.[6] ..... H01H 35/34

[52] U.S. Cl. ..... 200/83 B; 91/49; 92/99; 200/302.1; 200/306

[58] Field of Search ..... 91/1, 5, 49; 92/96, 92/98 R, 98 D, 99, 102; 307/118; 73/717, 723; 340/611, 626; 200/81 R, 83 R, 83 A, 83 B, 83 Q, 83 T, 83 W, 83 J, 302.1, 303, 306

[56] References Cited

U.S. PATENT DOCUMENTS

| | | | |
|---|---|---|---|
| 2,208,909 | 7/1940 | Miller . | |
| 2,537,308 | 1/1951 | Hansen | 200/83 Q |
| 2,837,611 | 6/1958 | Detwiler et al. . | |
| 2,852,642 | 9/1958 | Cromwell . | |
| 3,530,267 | 9/1970 | Whitmore . | |
| 3,717,734 | 2/1973 | Wertheimer et al. . | |
| 4,081,621 | 3/1978 | Hartley | 200/83 Q |
| 4,190,752 | 2/1980 | Rogers | 200/83 Q |
| 4,368,366 | 1/1983 | Kitamura | 200/83 Q |
| 4,388,856 | 6/1983 | Cook | 91/49 |
| 4,524,254 | 6/1985 | Yoshida | 200/83 R |
| 4,572,237 | 2/1986 | Thompson . | |
| 4,973,804 | 11/1990 | Cook | 200/61.48 |

*Primary Examiner*—Gerald P. Tolin

*Attorney, Agent, or Firm*—D. Peter Hochberg; Mark Kusner; Michael Jaffe

[57] ABSTRACT

A diaphragm assembly for movement in response to a pressure increase exerted thereon comprised of a resilient flexible diaphragm having a first surface with a predetermined profile when said diaphragm is in a neutral, unflexed condition, the diaphragm having an opening formed therethrough.

A rigid pressure plate is adapted to be positioned against the diaphragm. The plate has a contoured surface for mating engagement with the first surface of the diaphragm. The contoured surface has a recessed sealing surface dimensioned to form an open space between the plate and the diaphragm when the diaphragm is in the neutral, unflexed condition, and to enable the diaphragm to flex into sealing engagement therewith when sufficient pressure is exerted on said diaphragm. A first vent passage communicates the opening in diaphragm with the open space, and a second vent passage communicates the open space with the edge of the pressure plate.

25 Claims, 5 Drawing Sheets

PNEUMATIC ACUTATED SWITCH

FIELD OF THE INVENTION

The present invention relates to switch devices, and more particularly, to a pneumatic actuated switch having a diaphragm assembly that is sensitive to the rate of pressure change exerted thereon.

BACKGROUND OF THE INVENTION

Pneumatic actuated switches are used in applications where it is desirable to actuate an electrical component at a remote location by means of a pulse of air. Such switches typically have a diaphragm assembly disposed adjacent to an electrical switch. The diaphragm assembly includes a resilient diaphragm element disposed adjacent a pressure chamber. The diaphragm element is designed to move and activate the switch in response to a pressure increase in the pressure chamber. In general, the pressure chamber is connected by a circuit or channel, typically tubing, to a remote actuator or pressure source. The actuator and circuit or channel leading up to the pressure chamber are air tight to ensure transfer of a pressure pulse from the actuator or pressure source into the pressure chamber.

Such switches are often utilized in applications where the switch and actuator are exposed to elevated temperatures (e.g., furnace, hot tub, spa, jetted bathtub applications or the like). A problem with using such switches in these types of environments is that air confined within the pressure chamber, or the channel or circuit communicating with the actuator, may at elevated temperatures expand sufficiently to cause movement of the diaphragm element and unintentional activate the electric switch. To overcome this problem, some pneumatic actuated switches include a sintered metal disk, bleeder or like device which allow a slow release of pressure from the pressure chamber. The addition of these components in the pressure chamber, however, limits the type of electric switch which can be used with the pneumatic actuator. In this respect, a pressure increase applied to the diaphragm cannot be maintained for a prolonged period of time because the sintered disk or bleeder element allows a gradual release of pressure in the pressure chamber. Consequently, such arrangements are typically limited to use with "alternate action" switches, as compared to "dwell" or "momentary" switches. In this respect, "alternate action" switches activate instantaneously and typically require successive pressure pulses to move the diaphragm twice to cause an "on" and "off" cycle. On the other hand, "dwell" or "momentary" type switches remain "on" only so long as the switch's actuator is depressed. Release of the force on the actuator allows the switch to return to "off." In addition to the foregoing, the addition of sintered discs and bleeders to a pneumatic actuated switch increases the overall manufacturing cost of the switch.

The present invention overcomes these and other problems and provides a diaphragm assembly for use in a pneumatic actuated switching device, which diaphragm assembly is sensitive to the rate of pressure change exerted thereon. The diaphragm assembly is operable to allow gradual pressure release until the rate of pressure increase exerted thereon reaches a predetermined level sufficient to cause the diaphragm to move from a neutral unflexed position to a flexed condition, thereafter, further venting of pressure from the pressure chamber is prevented.

SUMMARY OF THE INVENTION

In accordance with the present invention, there is provided a diaphragm and pressure plate assembly for moving an actuator element in response to a rapid pressure increase exerted on one side thereof. The assembly is comprised of a resilient, flexible diaphragm element having a neutral unflexed condition with a predetermined surface profile. The diaphragm element has a first side adapted to be positioned adjacent a pressure chamber and a second side adapted to be positioned adjacent a pressure relief chamber. A rigid pressure plate is positioned against the second side of the diaphragm element. The pressure plate has a mating surface with surface contours that are formed to match the surface profile of the diaphragm element when the diaphragm element is in the neutral position. When the pressure plate is positioned against the diaphragm element, an open space is formed between the diaphragm element and the pressure plate. The pressure plate further includes a first vent passage communicating with the open space at a first location on the pressure plate and a second vent passage communicating with the open space at a second location on the pressure plate. The vent passages and open space define a pressure vent path when the diaphragm element is in the neutral position. A port is provided through the diaphragm element and connects the pressure chamber and with the first vent passage for venting gradual pressure buildups in the pressure chamber through the vent path. The diaphragm element is operable to flex into engagement with the surface contours on the pressure plate and isolate the first vent passage from the second vent passage when a pressure increase above a predetermined rate of change exists in the pressure chamber.

In accordance with another aspect of the present invention there is provided a pressure switch comprising a housing having at least one pressure chamber. A flexible diaphragm is provided within the housing adjacent the pressure chamber. An electric switch is mounted to the housing. A pressure plate is positioned against the diaphragm on the side of the diaphragm facing away from the pressure chamber. The pressure plate is adapted to be moved by the diaphragm to actuate the switch. The pressure plate includes a contoured surface facing the diaphragm and defining an open space between the plate and the diaphragm when the diaphragm is in a neutral, unflexed condition. A first vent passage communicates with the contoured surface, and a second vent passage communicates with the contoured surface. The vent passages and the open space define a vent path when the diaphragm is in a neutral, unflexed position. A port through the diaphragm communicates with the first vent passage. The port is dimensioned to permit gradual rates of pressure change to vent along the vent path and to cause the diaphragm to flex into surface engagement with the contoured surface when the rate of pressure change within the pressure chamber exceeds a predetermined rate of change.

In accordance with a still further aspect of the present invention there is provided a pressure switch comprised of a housing having a pressure chamber and a pressure relief chamber. A flexible diaphragm is positioned within the housing and has a first side facing the pressure chamber and a second side facing the pressure relief chamber. The diaphragm has a predetermined configuration when in a neutral, unflexed position. A rigid pressure plate is provided within the housing and is disposed against the second side of the diaphragm for movement with the diaphragm. The pressure plate has a contoured surface facing the diaphragm defining an open space between the plate and the diaphragm when the diaphragm is in a neutral, unflexed position. The diaphragm includes a first vent passage communicating with the contoured surface, and a second vent passage communicating with the contoured surface and communicating with the pressure relief chamber. A port extends through the diaphragm and communicates the pressure chamber with the first vent passage. The port is dimensioned wherein a pressure change within the pressure chamber below a predetermined rate of change is vented from the pressure chamber through said port and through said vent passages and through the opening defined between the pressure plate and the diaphragm. A pressure change at a rate above a predetermined rate of change causes the diaphragm to flex into surface contact with the contoured surface of the pressure plate so as to collapse the open space therebetween, thereby sealing the diaphragm against the pressure plate and isolating the first vent passage from the second vent passage and causing the diaphragm and the pressure plate to move in response to the pressure increase in the pressure chamber.

It is an object of the present invention to provide a flexible diaphragm assembly for use in a pneumatic actuator, which diaphragm assembly is sensitive to the rate of pressure change exerted thereon.

A still further object of the present invention is to provide a flexible diaphragm assembly as described above which is not susceptible to gradual increases in pressure exerted thereon.

Another object of the present invention is to provide a flexible diaphragm assembly as described above which allows gradual increases in pressure exerted thereagainst to be vented past the diaphragm assembly.

Another object of the present invention is to provide a flexible diaphragm assembly as described above wherein a rapid pressure increase exerted thereon will cause a diaphragm element to flex from a neutral, unflexed condition and thereafter prevent release of pressure exerted thereagainst.

A still further object of the present invention is to provide a flexible diaphragm assembly as described above which finds advantageous application with dwell switches or momentary switches.

Another object of the present invention is to provide a pneumatic actuated switch having a diaphragm element that is not susceptible to minor pressure variation exerted thereon caused by temperature fluctuations.

These and other objects and advantages will become apparent from the following description of the preferred embodiment of the invention taken together with the accompanying drawings.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof and wherein.

DESCRIPTION OF PREFERRED EMBODIMENT

Figure 1:
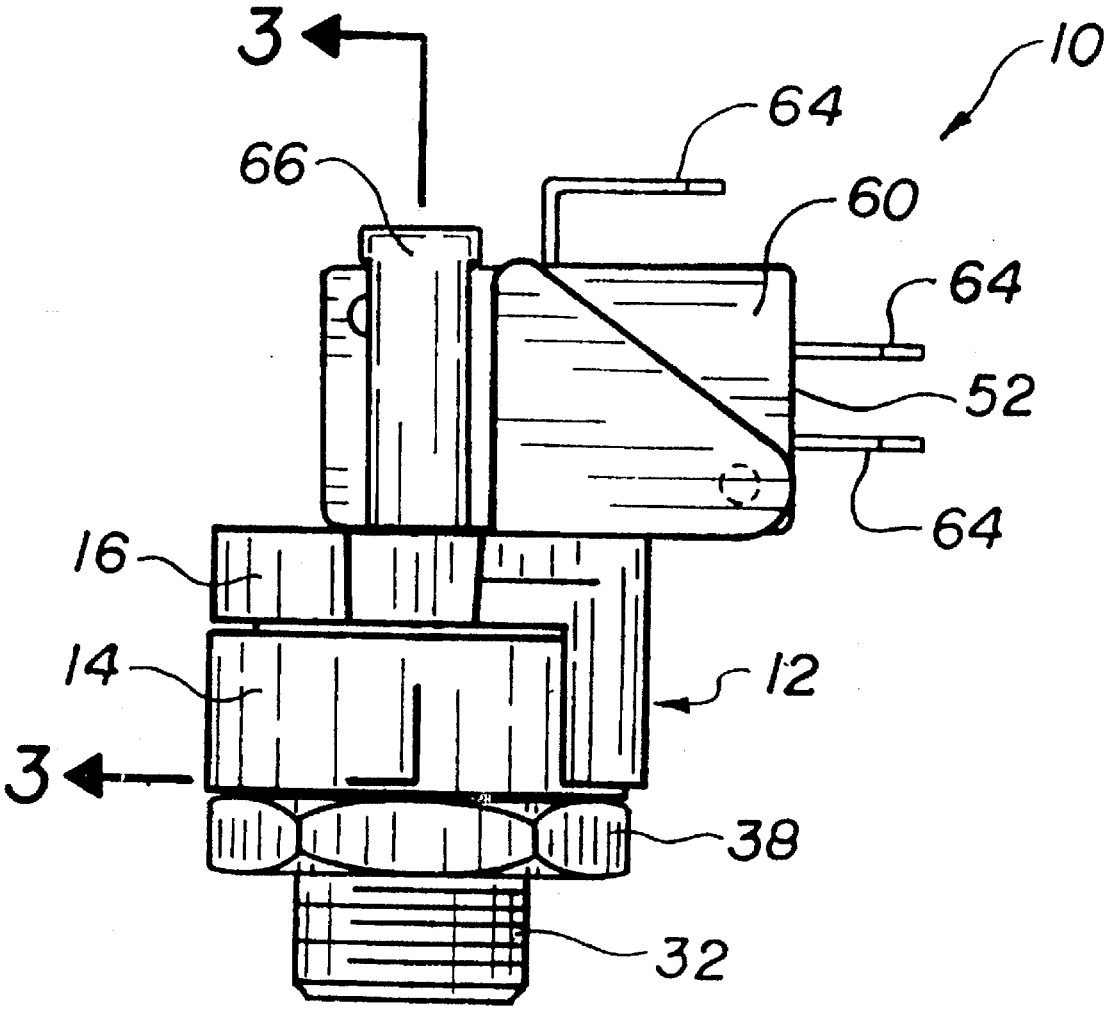
FIG. 1 is a side elevational view of a pneumatic actuated switch.
Figure 2:
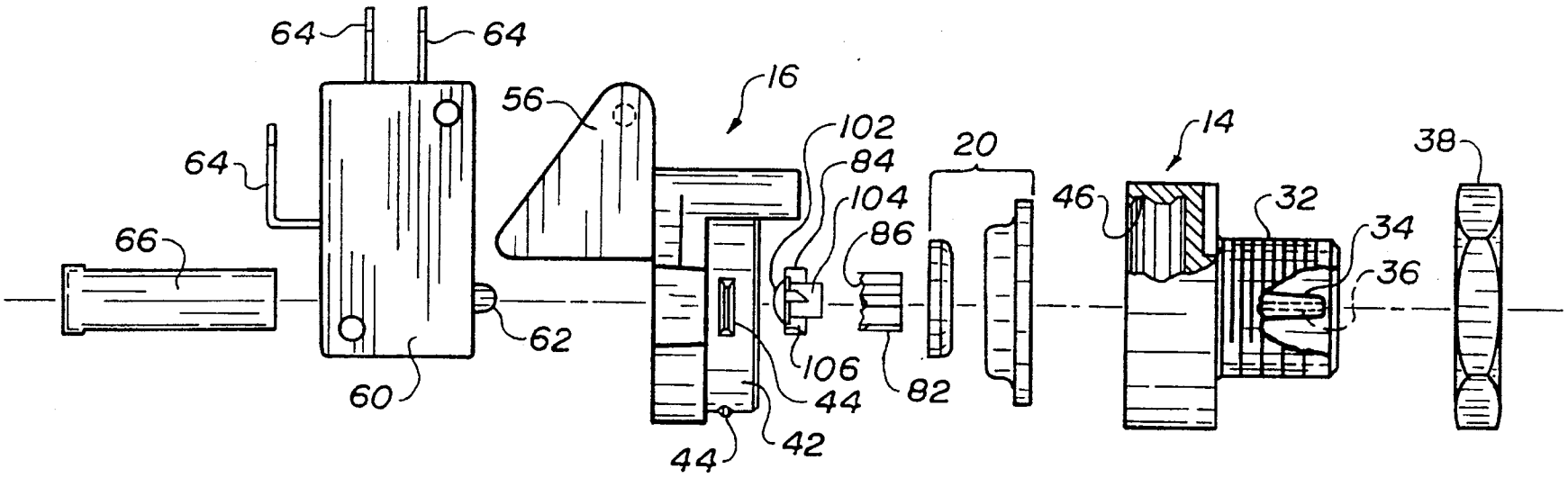
FIG. 2 is an exploded view of the pneumatic actuated switch shown in FIG. 1.

Referring now to the drawings wherein the showing is for the purpose of illustrating a preferred embodiment of the invention only, not for purpose of limiting same, the drawings show a pneumatic actuated switch 10. Switch 10 is generally comprised of a housing 12 having a base section 14 and a cover section 16 which are adapted to be attached to one another. In the embodiment shown, housing 12 is generally cylindrical in shape and includes a generally cylindrical inner cavity 18 (best seen in FIG. 3) which is dimensioned to receive a diaphragm assembly 20. Diaphragm assembly 20 is mounted within base section 14 to define a pressure chamber 22 below the diaphragm assembly 20 and a pressure relief chamber 24 above the diaphragm assembly 20. A threaded shank 32 is formed at the lower end of base section 14. Shank 32 surrounds a nozzle 34 which includes a channel 36 that communicates with pressure chamber 22. Nozzle 34 is adapted to receive a hose or tube (not shown) to connect pressure chamber 22 to a pressure source or actuating device (not shown). A fastener 38 is provided to be threadingly received on shank 32.

Figure 3:
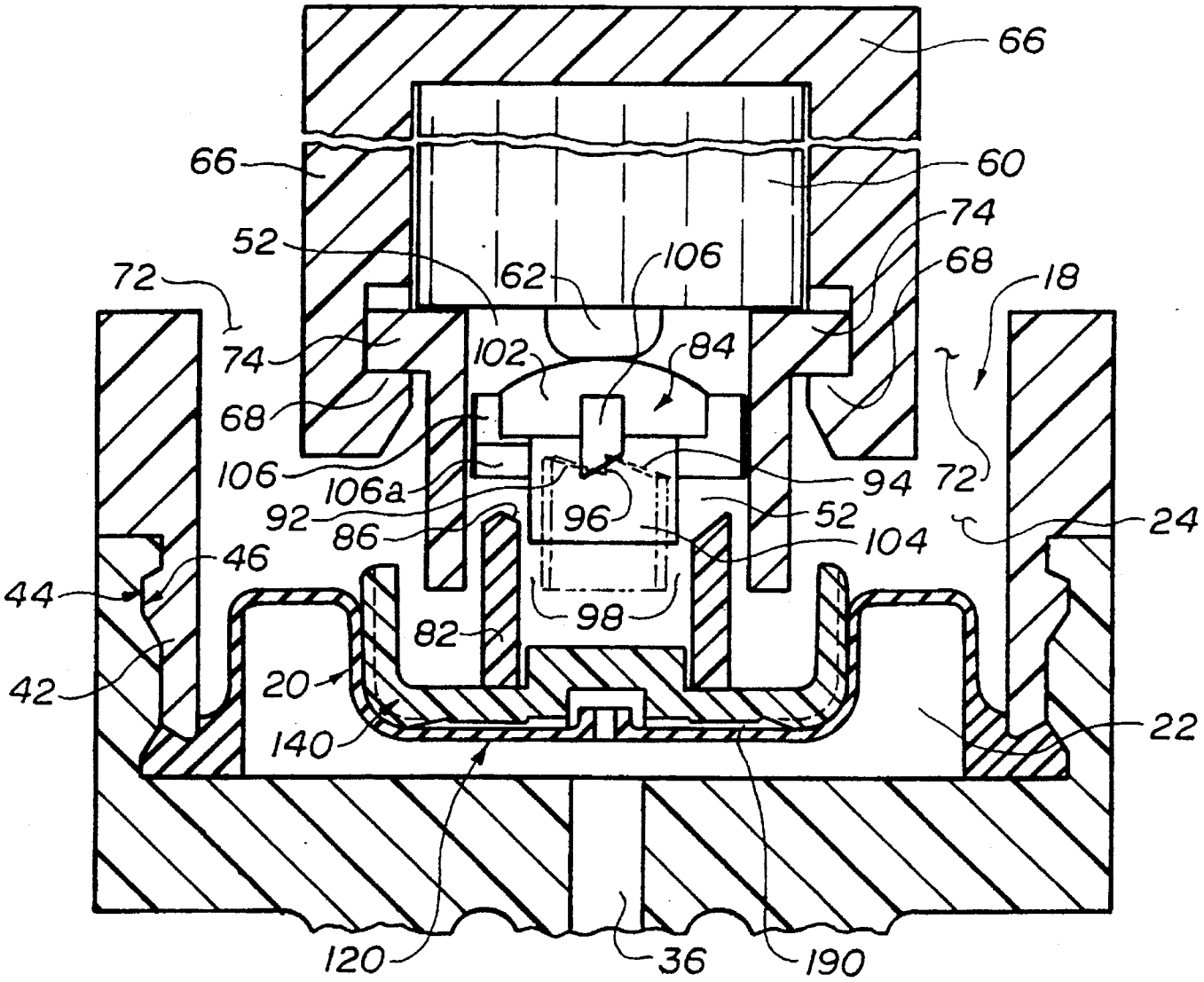
FIG. 3 is a sectional view taken along lines 3—3 of FIG. 1, showing a diaphragm assembly according to the present invention.

Cover section 16 includes a cylindrical lower end 42 having tabs 44 dimensioned to snap lock into an annular groove 46 in base section 14 so as to lock cover section 16 to base section 14, and to position diaphragm assembly 20. An opening 52 extends through cover section 16 to receive a switch actuating assembly, as will be described in greater detail below. Two spaced apart plates 56 are formed on cover section 16 and define a space therebetween to receive a switch 60. Switch 60 has a button 62 which activates the switch 60. In this respect, switch 60 is received by and between plates 56 such that pin or button 62 is disposed within opening 52 in cover section 16, as best seen in FIG. 3. A plurality of electrical leads 64 extend from switch 60 to connect switch 60 to a remote component to be regulated. A generally U-shaped retainer 66 is provided to be positioned over switch 60 and to snap lock onto openings 72 in cover section 16 so as to retain switch 60 therein. In this respect, the lower end of the U-shaped retainer 66 includes tabs 68 adapted to lock onto a lip 74 found on cover section 16.

A switch actuating assembly is provided above the diaphragm assembly 20 to actuate switch 60. In the embodiment shown, the actuating assembly is comprised of a racheting mechanism that is operable to activate the switch upon a first movement thereof and to deactivate the switch upon a second successive movement thereof. The racheting mechanism shown includes an axially movable sleeve 82 and a rotatable starwheel 84.

Sleeve 82 is slidably received within opening 52 of cover section 16. In this respect, sleeve 82 is freely slidable in opening 52 along the axis of switch 10. Guide means (not shown) prevent rotational movement of sleeve 82 about the axis of the switch. The upper end of sleeve 82 includes a plurality of inclined surfaces 86 for operative engagement with starwheel 84, as will be described in greater detail below.

Opening 52 through cover section 62 is generally cylindrical in shape to receive sleeve 82. Spaced-apart par of upward facing cam surfaces 92, 94 (shown in phantom in FIG. 3) are formed on the inner surface of opening 52, as best seen in FIG. 3. As shown in FIG. 3, a step 96 is formed between cam surfaces 94, 96. A slot or gap 98 is formed between each pair of cam surfaces 92, 94.

Starwheel 84 includes a domed or crowned upper end 102 adapted to engage button 62 of switch 60, and a cylindrical lower end 104 which is dimensioned to be received within the opening in sleeve 82. Starwheel 84 includes a plurality of equally-spaced, radially extending arms 106, each having an inclined surface **106*a* on the lower edge thereof. Arms 106 are dimensioned to engage cams surfaces 92, 94 of opening 52, as well as inclined surfaces 86 of sleeve 82. As shall be described in greater detail below, the racheting mechanism (i.e., sleeve 82 and starwheel 84) are operable to activate and deactivate switch 60 in response to movement of diaphragm assembly 20**.

Figure 4:
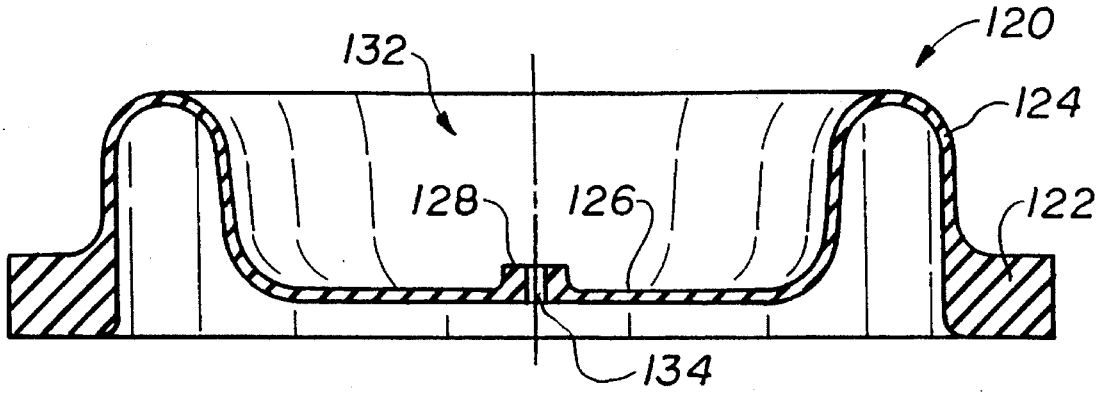
FIG. 4 is an isolated sectional view of a diaphragm element which forms a part of the diaphragm assembly shown in FIG. 3.

According to the present invention, diaphragm assembly 20 is generally comprised of a diaphragm element 120 and a pressure plate 140. In the embodiment shown, diaphragm element 120 is confined between base section 14 and cover section 16 to define pressure chamber 22 below diaphragm element 120 and pressure relief chamber 24 above. In the embodiment shown, diaphragm element 120, best seen in FIG. 4, is symmetrical about a central axis and includes an outer annular base portion 122, a generally U-shaped convolute portion 124, and a generally flat inner portion 126. Flat portion 126 is formed to include a central cylindrical boss 128. As seen in FIG. 4, convolute portion 124 and flat portion 126 of diaphragm element 120 define a smoothly contoured, cup-shaped cavity 132. According to the present invention, a small diameter axially aligned hole or aperture 134 extends through diaphragm element 120, and more specifically through cylindrical boss 128. In the embodiment shown, aperture 134 is approximately 0.015 inches in diameter. Diaphragm element 120 is preferably formed of a flexible resilient polymer material, and in the embodiment shown, is formed of silicone. Diaphragm element 120 is molded to have a neutral, unflexed configuration 120 as shown in FIG. 4. In this configuration, flat inner portion 126 of diaphragm element defines a generally flat, circular surface.

Figure 5:
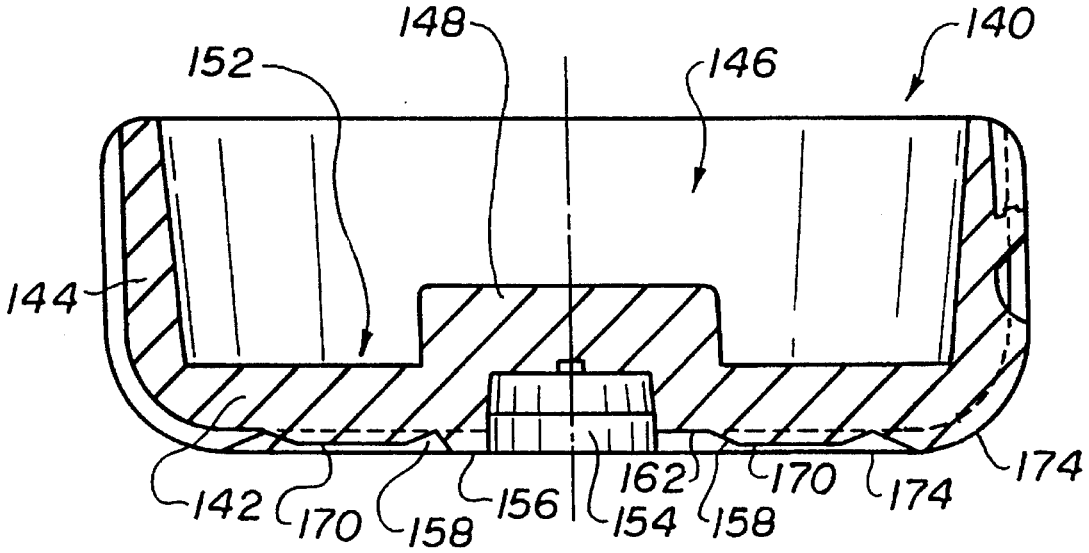
FIG. 5 is an isolated sectional view of a pressure plate which forms a part of the diaphragm assembly shown in FIG. 3.
Figure 6:
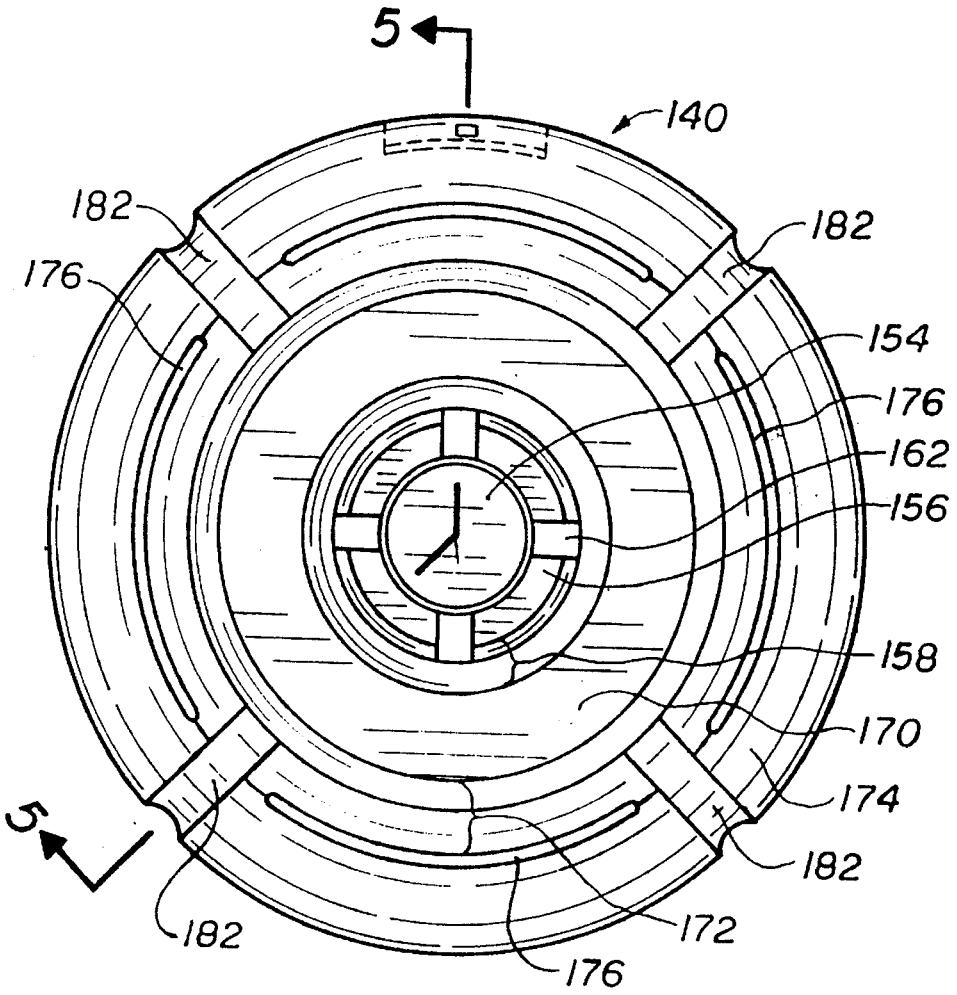
FIG. 6 is a bottom view of the pressure plate shown in FIG. 5.
Figure 7:
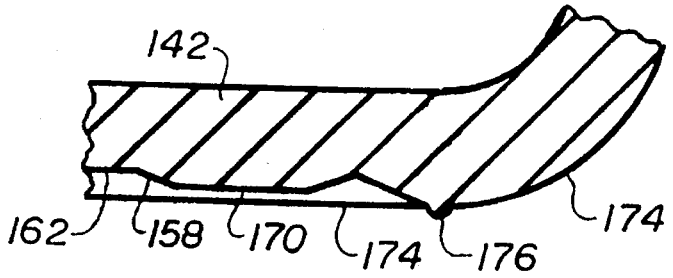
FIG. 7 is an enlarged view of a portion of the pressure plate shown in FIG. 5.

Referring now to FIGS. 5, 6 and 7, pressure plate 140 is best seen. According to the present invention, pressure plate 140 is formed of a rigid material and is adapted to be positioned against one side (i.e., the upper side) of diaphragm element 120. In the embodiment shown, pressure plate 140 is generally cup-shaped and is symmetrical about a central axis. Pressure plate 140 has a bottom wall portion 142 and a cylindrical side wall portion 144. Bottom wall portion 142 and side wall portion 144 define a generally cylindrical cavity 146. In the embodiment shown, a centrally located cylindrical boss 148 extends from the inner surface of bottom wall portion 142 and defines an annular groove or channel 152 within the cylindrical cavity 146. Channel 152 is dimensioned to receive and position sleeve 82 within housing 12.

The outer surface of pressure plate 140 is formed to have a predetermined surface profile generally matching the profile of the upper surface of diaphragm element 120. In other words, pressure plate 140 is formed to be set within cylindrical cavity 132 defined by diaphragm element 120 and to mate with the surface thereof. The outer surface of pressure plate 140 includes a centrally located, generally cylindrical cavity 154 disposed to be in registry with hole 134 in diaphragm element 120. Surrounding cavity 154 is an annular flat surface 156 (best seen in FIG. 6) which is formed to engage and abut the tipper surface of flat inner portion 126 of diaphragm element 120. Surrounding annular flat surface 156 is a first annular, generally V-shaped, groove 158. Four radially extending channels 162 are formed in pressure plate 140 and extend from V-shaped groove 158 to cylindrical cavity 154. Surrounding first V-shaped groove 158 is an annular flat sealing surface 170. Surrounding flat sealing surface 170, is a second annular, generally V-shaped, groove 172. Beyond second V-shaped groove 172, a peripheral edge portion 174 is formed. In the embodiment shown, pressure plate has a smooth, rounded corner defining its peripheral edge 174. Four (4) spaced-apart, arcuate steps 176 are formed along the outer edge of V-shaped groove 172, as best seen in FIGS. 6 and 7. Steps 176 extend a predetermined distance above edge portion 174 and above flat sealing surface 170. In the embodiment shown, steps 176 are rounded (as seen in FIG. 7) having 0.010" (inch) radius. Four (4) radially extending channels 182 are formed in the outer surface of the outer edge of pressure plate 140 and extend from second V-shaped groove 172 to the upper edge of side wall portion 144. Channels 182 extend radially outward from V-shaped groove 172 and are disposed between the lengthwise ends of arcuate steps 176.

Importantly, according to the present invention, sealing surface 170 is disposed a predetermined distance below the planar surface defined by flat portion 156, peripheral edge portion 174 and steps 176, as best seen in FIG. 7. In this respect, when pressure plate 140 is set upon diaphragm element 120, and diaphragm element 120 is in a neutral, unflexed condition, an annular open space 190 (best seen in FIG. 3) is defined between sealing surface 170 and the surface of diaphragm element 120. In other words, sealing surface 170 is recessed below the mating surfaces of pressure plate 140 and diaphragm element 120. Open space 190 defined between sealing surface 170 and the surface of diaphragm element 120, together with V-shaped grooves 158, 172 and channels 162, 182, define a vent path from aperture 134 in diaphragm element 120 to the outer extreme edge of pressure plate 140.

Referring now to the operation of diaphragm assembly 20, the present invention provides a diaphragm assembly which is responsive and sensitive to the rate of change of the pressure increase exerted thereon. In this respect, diaphragm assembly 20 is operable when in its neutral unflexed condition to allow gradual increases in pressure within pressure chamber 22 to be vented therepast, yet will move (i.e., flex) and actuate switch 60 in response to a rapid pressure increase in pressure chamber 22. Further venting of pressure past the diaphragm assembly 20 is prevented until the pressure exerted thereagainst has subsided, and diaphragm assembly 20 returns to its original neutral unflexed configuration.

More specifically, when in a neutral, unflexed condition, diaphragm element 120 and pressure plate 140 define a vent path past diaphragm element 120. In this respect, small aperture 134 through diaphragm element 120 communicates with cavity 154 formed within pressure plate 140. When diaphragm element 120 is in a neutral, unflexed condition, cavity 154, together with channels 162, 182, V-shaped grooves 158, 172 and the open space 190 defined between pressure plate 140 and sealing element 120, create a vent path which is sized to allow venting of gradual pressure increases which may occur within pressure chamber 22. The pressure is vented from pressure chamber 22 through aperture 134 in diaphragm element 120 along the vent path defined between diaphragm element 120 and pressure plate 140 to pressure relief chamber 24, which communicates with atmosphere external of switch 10. An example of such a gradual pressure increase would be the result of expansion of air within the pressure chamber due to temperature increase.

However, once the rate of change of the pressure increase within chamber 22 exceeds a predetermined level, aperture 134 through diaphragm element 120 and the vent path defined between diaphragm element 120 of pressure plate 140 no longer will be capable of venting such pressure buildup. As a result, the increased pressure exerted on diaphragm element 120 will force diaphragm element 120 up toward pressure plate 140, bringing flat inner portion 126 of diaphragm element 120 into surface engagement with annular sealing surface 170. The engagement between inner portion 126 of diaphragm element 120 and annular sealing surface 170 effectively forms a seal and closes the vent path through diaphragm element 120. The pressure increase in pressure chamber 22 will cause diaphragm element 120 and pressure plate 140 to move upward causing actuating mechanism (i.e., sleeve 82 and starwheel 82) into engagement with button 62 to actuate switch 60. Importantly, so long as the increased pressure remains within pressure chamber 22, diaphragm element 120 maintains surface contact with sealing surface 170 of pressure plate 140, and effectively maintains a seal preventing any bleeding or venting of pressure from the chamber 22 through aperture 134. Release of the pressure within pressure chamber 22 allows diaphragm element 120 to return to its neutral, unflexed condition wherein flat inner portion 126 of diaphragm element 120 is again spaced from sealing surface 170 of pressure plate 140 thereby defining the annular open space 190 therebetween and opening the vent path past pressure plate 140.

Referring now to the actuation of switch 60, the switch actuating mechanism is operable to move starwheel 84 sequentially between a first switch activated position and a second switch deactivated position. With the actuating arrangement shown in the drawing successive pressure pulses (i.e., successive movements of diaphragm assembly 20) are required to move starwheel 84 from its first switch actuating position to its second switch deactivating position, and visa versa.

Referring now to the operation of the switch actuating mechanism, as diaphragm assembly 20 is forced toward switch 60 by the pressure in pressure chamber 22, sleeve 82 engages starwheel 84 to move same upward into contact with switch button 62. The spring biasing force of button 62 of switch maintains a constant downward or opposing force on starwheel 84. In addition to moving starwheel 84 upward, sleeve 82 causes starwheel 84 to rotate axially. In this respect, inclined surfaces 86 on sleeve 82 engage inclined edges **106*a* on arms 106 of starwheel 84 in such a manner so as to cause slight rotation of starwheel 84. This slight rotation affects where inclined edges 106*a* of starwheel 84 will contact cam surfaces 92, 94 on cover section 16, and the point of contact between arms 106 of starwheel 84 and cam surfaces 92, 94 determines the operating position of starwheel 84. In one respect, the engagement of inclined surfaces with cam surfaces 92, 94 produces a rotational effect on starwheel 84. In another respect, the configuration of the pairs of cam surfaces 92, 94 and gap 88 causes starwheel 84 to move between the above-identified first and second positions. In this respect, movement of diaphragm assembly 20 causes sleeve 82 to move starwheel 84 against switch button 62. Sleeve 82 has sufficient travel to move the lower inclined edges 106*a* of arms 106 above cam surfaces 92, 94. As indicated above, inclined surfaces 86 on sleeve 82 will cause starwheel to rotate slightly. When the pressure is removed from diaphragm assembly 20, the biasing force of switch button 62 will cause starwheel 84 to move away from switch 60, wherein inclined surfaces will engage either cam surface 92 or cam surface 94**.

If arm 106 engages cam surface 92, it will slide down such surface until it abuts step 96. Starwheel 84 is then in its first "switch activated" position, wherein it maintains switch button 62 in a depressed, activated state. With the next pressure pulse in pressure chamber 22, diaphragm assembly 20 causes sleeve 82 to move starwheel 84 off of cam surface 92 a sufficient distance to clear step 96. Again, sleeve 82 causes starwheel 84 to axial rotate slightly, such that when the pressure is removed from diaphragm assembly 20, arm 106 contacts cam surface 94. As the biasing force of switch button 62 forces starwheel 84 away from switch 60, arms 106 slide down cam surface 94 until arm 106 align with gaps 98. In this position, starwheel 84 is forced away from switch 60 by the biasing force of button 62, until button 62 is no longer depressed. With arms 106 of starwheel 84 aligned in gaps 98, starwheel 84 assumes its second "switch deactivated" position. A subsequent pressure pulse with move starwheel 84 to the first switch actuated position in the manner previously described.

While the switch embodiment shown utilizes a racheting type of actuating mechanism, diaphragm assembly 20, according to the present invention, may also use a simple actuating pin between diaphragm assembly 20 and switch button 62, wherein switch 60 will be actuated so long as diaphragm assembly 20 maintains the pin against switch button 62. Because diaphragm assembly 20, once activated under pressure, does not vent or release pressure from pressure chamber 22, switch 60 will remain actuated so long as pressure is exerted on diaphragm assembly 20.

The present invention thus provides a switch 10 and diaphragm assembly 20 which compensate for gradual pressure increases which occur within the pressure chamber 22, such as increases which might occur as a result of temperature increases in the surrounding environment. Further, a diaphragm assembly according to the present invention prevents venting of the pressure chamber once the pressure within the pressure chamber is sufficient to effect the diaphragm assembly 20. The present invention thus provides a diaphragm assembly 20 which may be used with either an alternate action switch or a momentary or dwell switch.

The present invention has been described with respect to preferred embodiments. Modifications and alterations will occur to others upon their reading and understanding of the specification. It is intended that all such modifications and alterations be included insofar as they come within the scope of the patent as claimed or the equivalents thereof.

Having described the invention, the following is claimed:

1. A pressure switch comprising:

a housing having at least one pressure chamber, a flexible diaphragm within said housing adjacent said pressure chamber;

an electric switch mounted to said housing;

a pressure plate positioned against said diaphragm on the side of said diaphragm facing away from said pressure chamber, said pressure plate adapted to be moved by said diaphragm to actuate said switch in response to a pressure change in said pressure chamber, said pressure plate including:

a sealing surface facing said diaphragm and defining an open space between said plate and diaphragm, a first vent passage communicating with said open space, and a second vent passage communicating with said open space and with a pressure relief chamber, said vent passages and said open space defining a vent path when said diaphragm is in said neutral position, and a port through said diaphragm communicating with said first vent passage, said port dimensioned to permit gradual rates of pressure change to vent along said vent path.

2. A pressure switch as defined in claim 1 wherein said diaphragm is molded of a flexible, resilient material and has a predetermined configuration in a neutral, unflexed condition, and said pressure plate has an outer surface formed to generally mate with and engage said diaphragm.

3. A pressure switch as defined in claim 2 wherein said sealing surface is recessed from said outer surface profile of said pressure plate.

4. A pressure switch as defined in claim 3 wherein said pressure plate is generally symmetrical about a central axis.

5. A pressure switch as defined in claim 4 wherein said first and second vent passages are channels formed along said outer surface which communicate with said open space.

6. A pneumatic actuator comprising:

a housing having a pressure chamber and a pressure relief chamber;

a diaphragm within said housing having a first side facing said pressure chamber and a second side facing said pressure relief chamber, said diaphragm formed of a flexible material and having a neutral unflexed configuration;

a rigid pressure plate within said housing disposed against said second side of said diaphragm for movement with said diaphragm, said pressure plate having a sealing surface facing said diaphragm defining an open space between said plate and said diaphragm when said diaphragm is in said neutral unflexed configuration, a first vent passage communicating with said sealing surface, and a second vent passage communicating with said sealing surface and with said pressure relief chamber;

a port through said diaphragm connecting said pressure chamber with said first vent passage, said port dimensioned wherein a pressure change within said pressure chamber below a predetermined rate of change is vented from said pressure chamber through said port, through said vent passages and through said opening defined between said pressure plate and said diaphragm, and a pressure change at a rate above a predetermined rate of change causes said diaphragm to flex into surface contact with said sealing surface of said pressure plate so as to collapse the open space therebetween sealing said diaphragm against said pressure plate, thereby isolating said first vent passage from said second vent passage and causing said diaphragm and said pressure plate to move in response to said pressure increase in said pressure chamber; and an actuator movable in response to movement of said diaphragm.

7. A pneumatic actuator as defined in claim 6 wherein said diaphragm has a predetermined surface profile in said neutral configuration, and said pressure plate has an outer surface profile mating with the surface profile of said diaphragm, said sealing surface being recessed below the surface profile of said pressure plate.

8. A pneumatic actuator as defined in claim 7 wherein said pressure plate is generally symmetrical about a central axis.

9. A pneumatic actuator as defined in claim 7 wherein said sealing surface is a flat, annular surface.

10. A diaphragm and pressure plate assembly for moving an actuator element in response to a rapid pressure increase exerted on one side of said diaphragm, said assembly comprised of:

a resilient, flexible diaphragm element having a predetermined surface profile in a neutral unflexed condition, said diaphragm having a first side positioned adjacent a pressure chamber and a second side positioned adjacent a pressure relief chamber, a rigid pressure plate positioned against said second side of said diaphragm, said pressure plate having a mating surface with surface contours which form an open space with said second side of said diaphragm when said diaphragm is in said neutral unflexed condition, said pressure plate further including a first vent passage communicating with said surface contours at a first location on said pressure plate and a second vent passage communicating with said surface contours at a second location on said pressure plate, said vent passages and said open space define a pressure vent path when said diaphragm is in said neutral position, a port through said diaphragm communicating with said pressure chamber and with said first vent passage, for venting gradual pressure buildups in said pressure chamber through said vent path, said diaphragm flexing into surface engagement with said surface contours on said pressure plate and isolating said first vent passage from said second vent passage when a pressure increase above a predetermined rate of change exists in said pressure chamber.

11. A diaphragm and pressure plate assembly as defined in claim 10 wherein said surface contours include a recessed surface which is spaced from said diaphragm when said diaphragm is in a neutral, unflexed configuration.

12. A diaphragm and pressure plate assembly as defined in claim 11 wherein said diaphragm includes a generally flat circular portion, said pressure plate includes a circular portion mating therewith, and said recessed surface is a flat annular surface.

13. A diaphragm and pressure plate assembly as defined in claim 12 wherein said diaphragm and said pressure plate are generally symmetrically about a central axis.

14. A diaphragm and pressure plate assembly as defined in claim 12 wherein said first vent passages and said second vent passages are grooves formed in said pressure plate.

15. A diaphragm and pressure plate assembly as defined in claim 12 wherein said diaphragm includes a convolute portion and is formed of a silicone material.

16. A diaphragm assembly for movement in response to a pressure increase exerted thereon comprised of:

a resilient flexible diaphragm having a first surface with a predetermined profile when said diaphragm is in a neutral, unflexed condition, said diaphragm having an opening therethrough;

a rigid pressure plate movable with and positioned against said diaphragm, said plate having a contoured surface for mating engagement with said first surface of said diaphragm, said contoured surface having a recessed sealing surface forming an open space between said plate and said diaphragm when said diaphragm is in said neutral, unflexed condition, and enabling said diaphragm to flex into sealing engagement therewith when sufficient pressure is exerted on said diaphragm, a first vent passage in said pressure plate communicating said opening in diaphragm with said contoured surface, and a second vent passage in said pressure plate communicating said contoured surface with the edge of said pressure plate.

17. A diaphragm assembly as defined in claim 16 wherein said diaphragm includes a generally flat circular portion when said diaphragm is in said neutral configuration.

18. A diaphragm assembly as defined in claim 17 wherein said pressure plate includes a circular portion for mating with said flat circular portion of said diaphragm, said recessed sealing portion being a flat annular surface formed in said circular portion of said plate.

19. A diaphragm assembly as defined in claim 18 wherein said pressure plate is generally symmetrical about a central axis and includes a centrally located cavity located to be in registry with said opening in said diagram, said first vent passage communicating said cavity with said open space.

20. A diaphragm assembly as defined in claim 19 wherein said first and said second passages are channels formed in the contoured surface of said pressure plate.

21. A diaphragm assembly as defined in claim 20 wherein said diaphragm includes a convolute portion and is formed of a silicone material.

22. A diaphragm assembly for use in a pneumatic actuated switch comprised of:

a flexible diaphragm formed of a resilient material having a neutral, unflexed configuration and a predetermined diaphragm surface profile in said unflexed configuration, said diaphragm having an aperture formed therethrough;

a pressure plate positioned against said diaphragm and having an outer surface defining a pressure plate surface profile generally conforming to the surface profile of said diaphragm so as to mate therewith, said plate having a recessed annular surface facing said diaphragm, said recessed annular surface forming an annular gap with said diaphragm when said diaphragm is in said neutral, unflexed configuration;

a first vent path formed in said pressure plate within the diameter of said annular surface, said first vent path communicating said annular gap with said port in said diaphragm; and a second vent path formed in said pressure plate communicating said annular gap with an outer side of said plate.

23. A diaphragm assembly as defined in claim 22 wherein said first and second vent paths are channels formed in said pressure plate.

24. A diaphragm assembly as defined in claim 22 wherein said diaphragm includes a convolute portion and is formed of a silicone material.

25. A diaphragm assembly as defined in claim 22 wherein said pressure plate is generally symmetrical about a central axis.

* * * * *